US008732965B2

(12) United States Patent
Efthimiadis et al.

(10) Patent No.: US 8,732,965 B2
(45) Date of Patent: May 27, 2014

(54) RAZOR HANDLES TO BE RELEASABLY CONNECTED TO SHAVING CARTRIDGES AND RAZORS INCLUDING SUCH HANDLES

(75) Inventors: Dimitris Efthimiadis, Nea Kypseli-Athènes (GR); Ioannis Bozikis, Koukaki-Athens (GR); Spiros Gratsias, Kypseli-Athènes (GR)

(73) Assignee: BIC-Violex SA, Anixi, Attiki (GR)

( * ) Notice: Subject to any disclaimer, the term of this patent is extended or adjusted under 35 U.S.C. 154(b) by 406 days.

(21) Appl. No.: 13/121,336

(22) PCT Filed: Oct. 1, 2008

(86) PCT No.: PCT/EP2008/063187

§ 371 (c)(1),
(2), (4) Date: Jun. 24, 2011

(87) PCT Pub. No.: WO2010/037418

PCT Pub. Date: Apr. 8, 2010

(65) Prior Publication Data

US 2011/0239475 A1 Oct. 6, 2011

(51) Int. Cl.
*B26B 21/40* (2006.01)
*B26B 21/14* (2006.01)

(52) U.S. Cl.
USPC ..... 30/526; 30/527

(58) Field of Classification Search
USPC ..... 30/527, 526, 41.7, 34.05, 32, 50
See application file for complete search history.

(56) References Cited

U.S. PATENT DOCUMENTS

| | | | | |
|---|---|---|---|---|
| 7,200,942 | B2 * | 4/2007 | Richard | 30/526 |
| 7,874,076 | B2 * | 1/2011 | Gratsias et al. | 30/526 |
| 8,015,711 | B2 * | 9/2011 | Psimadas et al. | 30/34.1 |
| 8,205,344 | B2 * | 6/2012 | Stevens | 30/527 |
| 8,209,868 | B2 * | 7/2012 | Schnak et al. | 30/45 |
| 8,230,600 | B2 * | 7/2012 | Hart et al. | 30/41.7 |
| 2007/0214662 | A1 | 9/2007 | Efthimiadis et al. | |

FOREIGN PATENT DOCUMENTS

| | | |
|---|---|---|
| GB | 2 093 750 | 9/1982 |

* cited by examiner

*Primary Examiner* — Omar Flores Sanchez
(74) *Attorney, Agent, or Firm* — Jones Day

(57) ABSTRACT

A razor handle including an elongated handle body integral with a flexible yoke for receiving and releasably retaining a shaving cartridge. The razor handle also includes a slide element cooperating with the yoke and connected to the handle body, the slide element being movable relative to the handle body between a rest position, in which the yoke is open and can releasably retain a shaving cartridge received in the yoke, and a release position, in which the yoke is flexed and can receive a shaving cartridge or release a shaving cartridge received in the yoke. The razor handle further includes a spring member to return the slide element from the release position to the rest position, where a stop element prevents the yoke from inadvertently flexing when the slide element is in the rest position.

11 Claims, 10 Drawing Sheets

FIG. 5
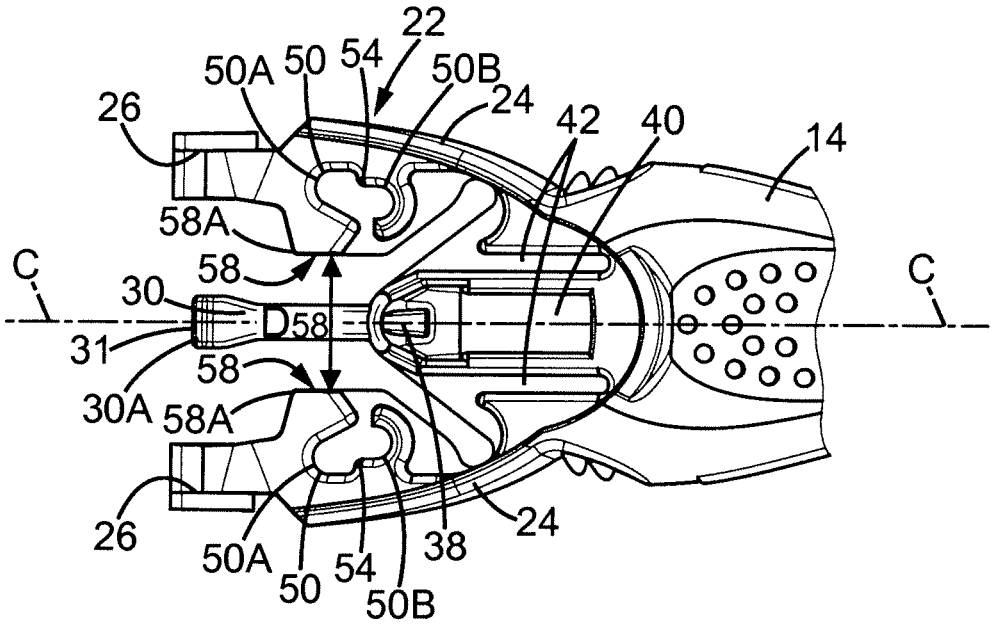
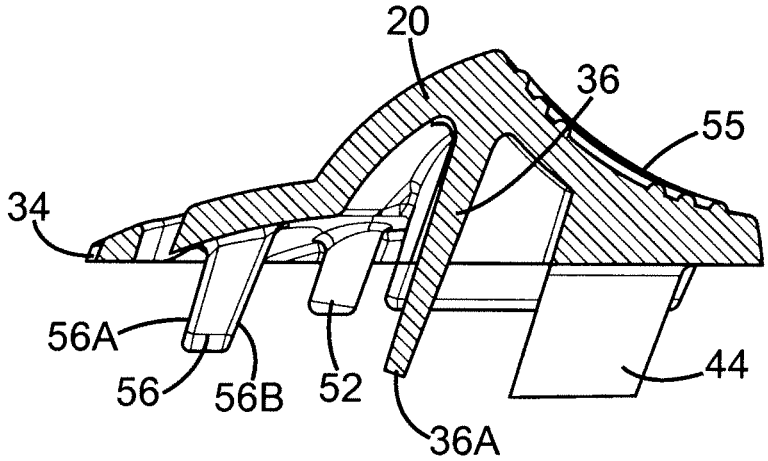
FIG. 6

RAZOR HANDLES TO BE RELEASABLY CONNECTED TO SHAVING CARTRIDGES AND RAZORS INCLUDING SUCH HANDLES

CROSS REFERENCE TO RELATED APPLICATION

This application is a national stage application of International Application No. PCT/EP2008/063187 ("the '187 Application"), filed on Oct. 1, 2008, the entire contents of the '187 Application being incorporated herein by reference.

FIELD OF THE INVENTION

The embodiments of the present invention are concerned with razor handles to be releasably connected to shaving cartridges and razors that include such handles.

Such a razor handle allows a shaving cartridge connected to it to be retained and to be released after use. After one or several uses, the user can discard the shaving cartridge and keep the razor handle to which he can connect a new shaving cartridge.

BACKGROUND OF THE INVENTION

In the known razors like those disclosed for example in GB 2 093 750, the razor handle has a body provided with a flexible yoke able to flex according to the sliding of an actuator cooperating with the body to facilitate receiving and retaining a shaving cartridge in pivotal and releasable fashion in the yoke.

Therefore, when the yoke flexes, the shaving cartridge is released.

Consequently, the use of such a razor may be dangerous for the user, especially because the user can cut themselves with the blade edge(s) of the shaving cartridge. This risk can also occur with children manipulating such a razor, or more specifically, this risk can occur when traveling, since the razor can be exposed to several forces/shocks leading to the accidental release of the shaving cartridge. Indeed, when the user wants to take his/her razor in their bag, the user may contact the shaving cartridge and cut themselves.

SUMMARY OF THE EMBODIMENTS OF THE PRESENT INVENTION

An embodiment of the present invention is directed to a razor handle including an elongated handle body that terminates in a flexible yoke for receiving and releasably retaining a shaving cartridge. The razor handle further includes a slide element that cooperates with the yoke and is connected to the handle body, where the slide element is movable relative to the handle body between a rest position (in which the yoke is open and can releasably retain a shaving cartridge received in the yoke) and a release position (in which the yoke is flexed and can receive a shaving cartridge or release a shaving cartridge received in the yoke). Further, the razor handle includes a spring member to return the slide element from the release position to the rest position. Additionally, the razor handle includes a stop element to prevent the yoke from inadvertently flexing when the slide element is in the rest position.

BRIEF DESCRIPTION OF THE DRAWINGS

Preferred features of embodiments of the present invention are disclosed in the accompanying drawings, wherein similar reference characters denote similar elements throughout the several views, and wherein:

FIG. 5 is a partial upper view of a razor handle according to an embodiment of the present invention;

FIG. 6 is a longitudinal section of a slide element of a razor handle according to an embodiment of the present invention;

DETAILED DESCRIPTION OF THE EMBODIMENTS OF THE PRESENT INVENTION

Figure 1A:
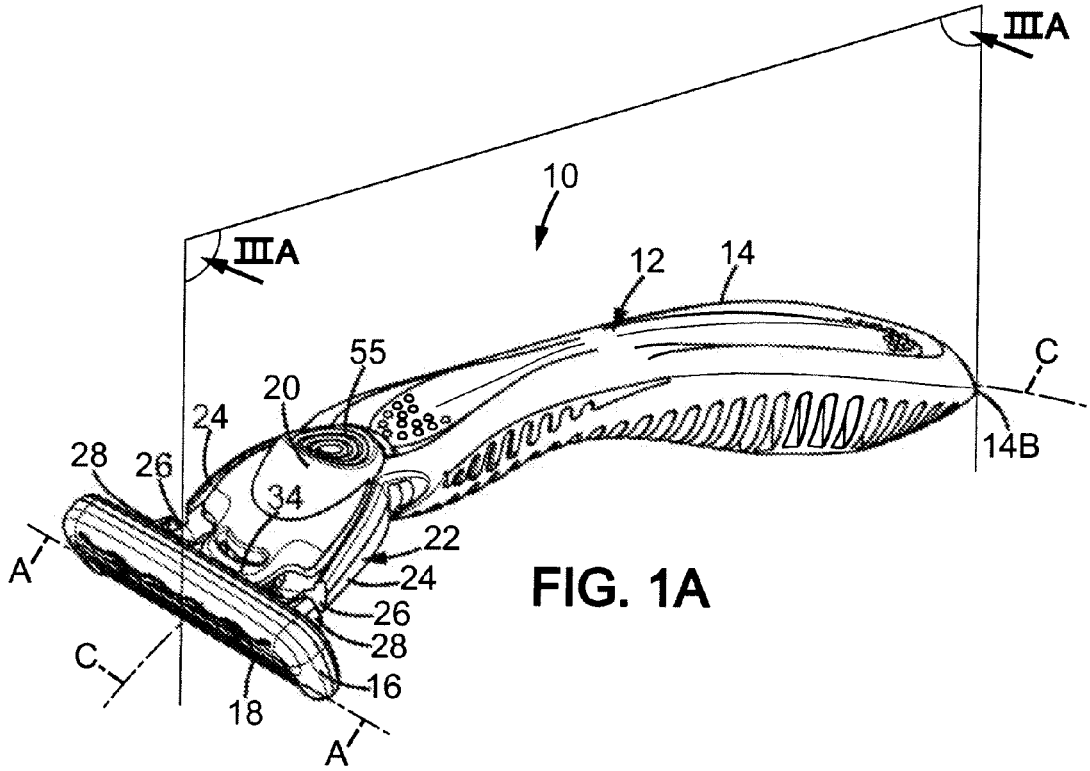
FIG. 1A is a perspective view of a razor handle according to an embodiment of the present invention.

The present invention will now be described more fully hereinafter with reference to the accompanying drawings, in which preferred embodiments of the invention are shown. This invention may, however, be embodied in many different forms and should not be construed as limited to the illustrated embodiments set forth herein.

In the following description, like reference characters designate like or corresponding parts throughout the figures. Additionally, in the following description, it is understood that terms such as "forward," "back," and the like, are words of convenience and are not to be construed as limiting terms.

FIG. 1A illustrates a razor 10 including a razor handle 12 having a handle body 14 releasably retaining a disposable shaving cartridge 16. In a preferred embodiment of the present invention, the handle body 14 is molded out of a plastic material and is elongated, extending along a longitudinal direction C-C between a front end 14A and a back end 14B. The shaving cartridge 16 is provided with one or more blades 18 each having a blade edge 18A extending parallel to a pivot axis A-A that is perpendicular to the longitudinal direction C-C when the shaving cartridge 16 is connected to the razor handle 12.

The razor handle 12 further includes a slide element 20 lockingly connected to the razor handle 12 and movable between a rest position (depicted in FIG. 1A) and a release position (depicted in FIG. 1B), and vice versa. In its rest position (FIG. 1A) the slide element 20 may be located toward the back end 14B of the handle body 14, whereas in its release position (FIG. 1B) it may be located forward toward the front end 14A of the handle body 14.

The handle body 14 terminates in a flexible yoke 22 that extends forward for receiving and releasably retaining the shaving cartridge 16 as depicted in FIG. 1A. In an embodiment of the present invention, the yoke 22 may include at least two flexible arms 24 extending forward from both sides of the longitudinal direction C-C. The yoke 22 is in its open position when the slide element 20 is in its rest position. The yoke 22 flexes when the slide element 20 is in its release position.

In an embodiment of the present invention, each arm 24 may be provided with a connecting means allowing their connection to a respective connecting means provided on the shaving cartridge 16. These connecting means are those typically used in the art to pivotably connect a shaving cartridge; they may, for example, be journal bearings, shell-bearings, or the like.

Figure 1B:
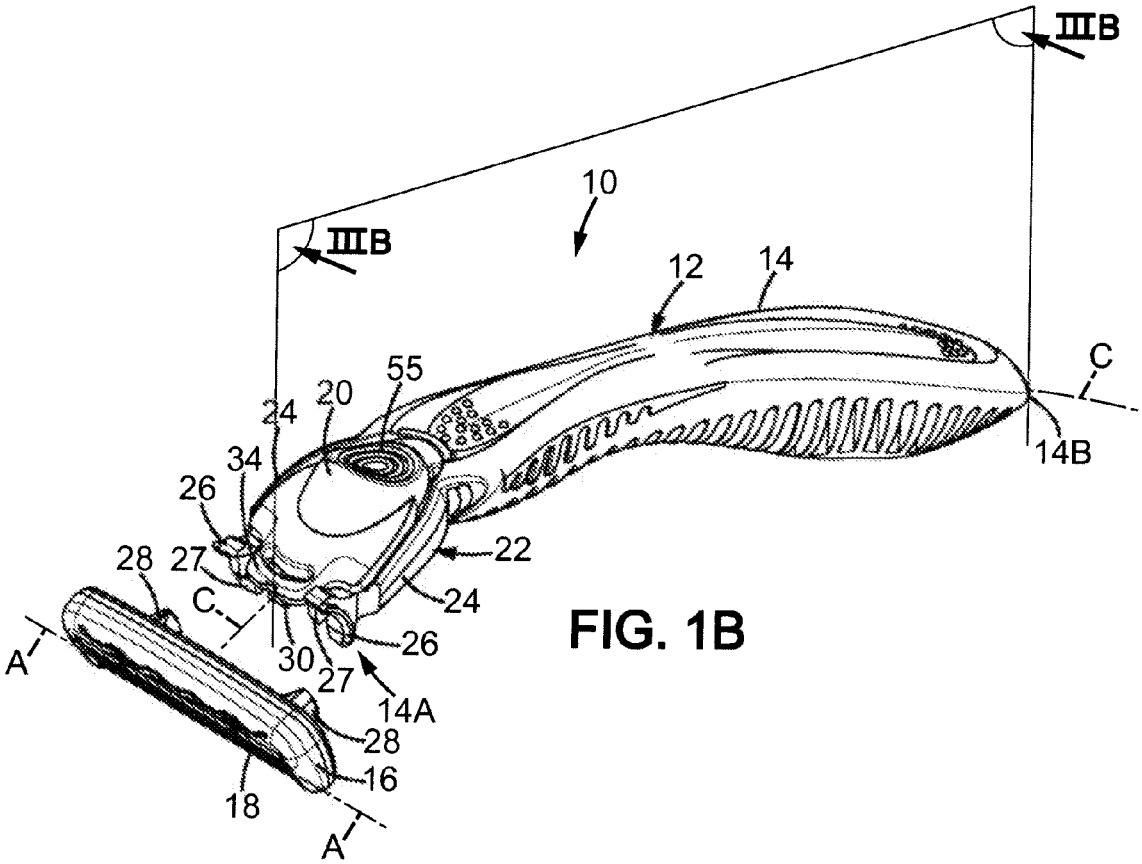
FIG. 1B is a perspective view of a razor handle according to an embodiment of the present invention with the shaving cartridge released.
Figure 2:
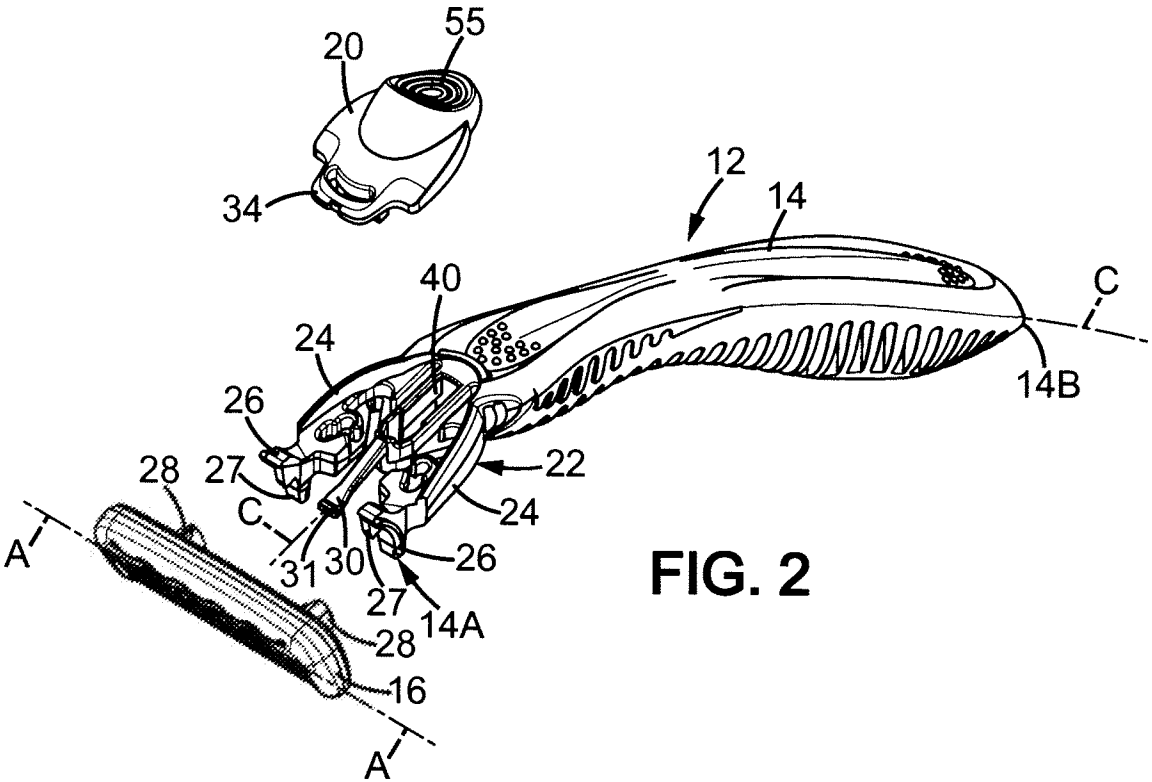
FIG. 2 is a perspective exploded view of a razor handle according to an embodiment of the present invention.

In the embodiments depicted in the figures, a shell-bearing 26 that is well-known in the art is provided on the free ends of each of the at least two arms 24 extending forward toward the shaving cartridge 16. These shell-bearings 26 can be connected to corresponding rearwardly protruding connectors 28, which are arcuate in shape and provided on the shaving cartridge 16 (as best seen in FIGS. 1B and 2). This connection may also be of any other known type in the art that is not detailed herein.

Figure 3A:
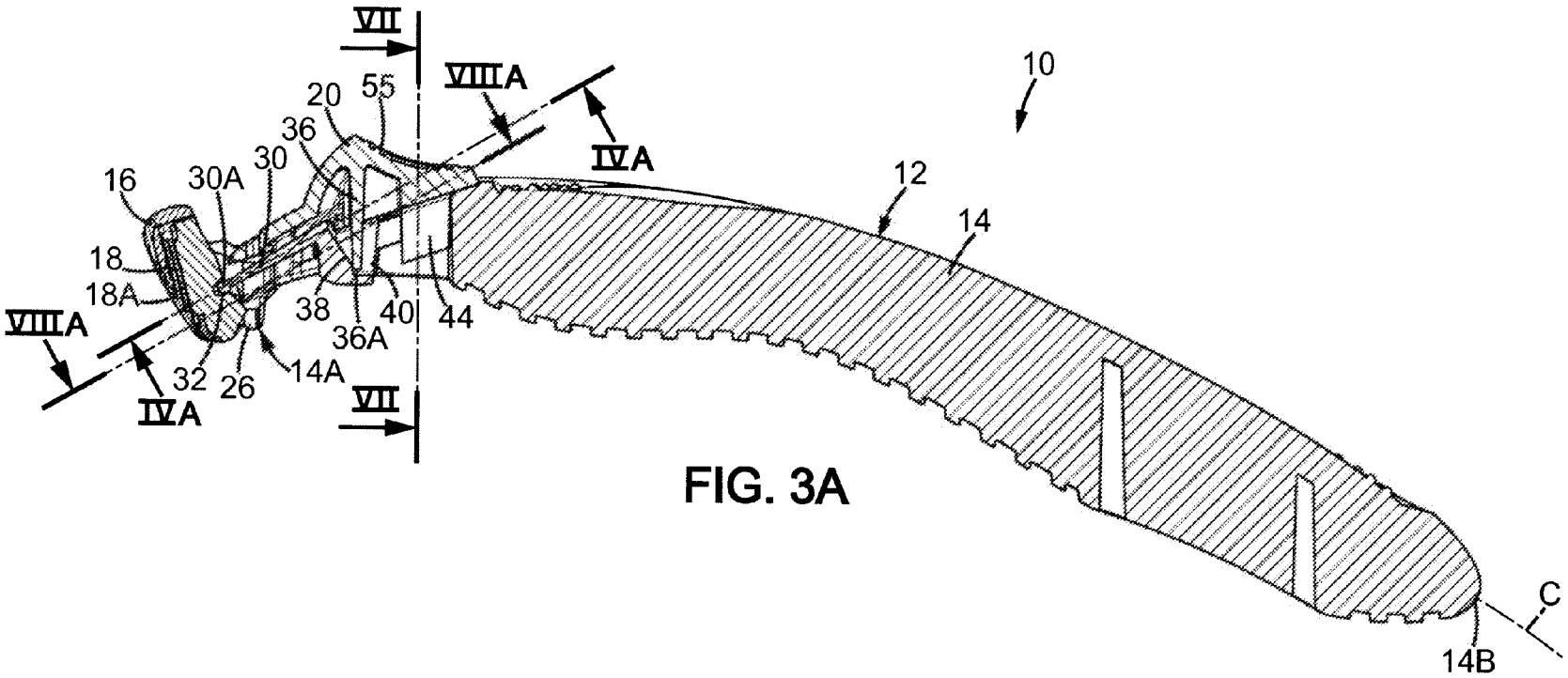
FIG. 3A is a longitudinal section of the razor handle shown in FIG. 1A along line IIIA-IIIA.
Figure 3B:
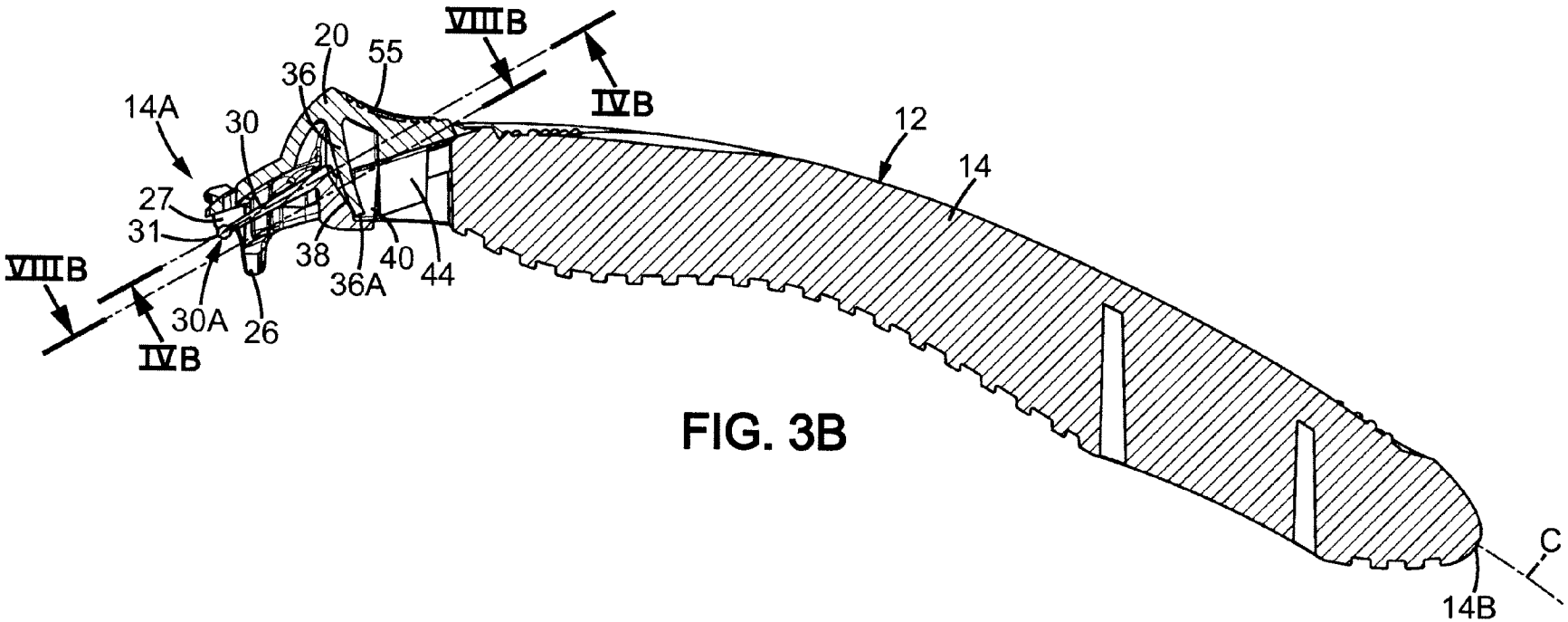
FIG. 3B is a longitudinal section of the razor handle shown in FIG. 1B along line IIIB-IIIB.

As best seen in FIGS. 2, 3A and 3B, the handle body 14 may further be provided with an elastic tongue 30 for biasing the shaving cartridge 16 toward a rest position. In a preferred embodiment of the present invention, the elastic tongue 30 is molded as a single piece with the handle body 14 and extends centrally along the longitudinal direction C-C. The elastic tongue 30 preferably extends beyond the shell-bearings 26. More precisely, in a preferred embodiment of the present invention, the tip 31, because it is located toward the front end on the elastic tongue 30, is closer to the pivot axis A-A than any part of the shell-bearings 26 or the flanges 27 extending from the shell-bearings 26 laterally in a plane perpendicular to the pivot axis A-A.

The elastic tongue 30 may be provided with a twin-cam follower 30A cooperating with corresponding cam surfaces 32 provided on the shaving cartridge 16 to allow for pivoting in two directions, where the rest position may correspond, for example, to the midway position. The elastic tongue may however be provided with a single-cam follower (not illustrated) cooperating with a corresponding cam surface provided on the shaving cartridge to allow a pivoting only in one direction.

The slide element 20 is further provided with a pusher 34 to push a shaving cartridge 16 connected to the razor handle 12 away from the handle body 14. When the slide element 20 slides forward toward the shaving cartridge 16 in its release position, the arms 24 of the yoke 22 preferably flex inwardly as depicted in FIG. 1B leading to the separation of the shell-bearings 26 from the rearwardly protruding connectors 28. Meanwhile, the pusher 34 (provided on the slide element 20), which is also moved forward, pushes the shaving cartridge 16 away from the handle body 14.

A spring member is further provided on the razor handle 12 to return the slide element 20 from the release position (depicted in FIG. 1B) to the rest position (depicted in FIG. 1A). More specifically, the spring member may include a leaf spring 36 provided on the slide element 20 that bears against a bearing surface 38 provided on the handle body 14 (as best seen in FIGS. 3A, 3B, 4A and 4B). A central groove 40 provided on the handle body 14 (as best seen in FIG. 5) forms a recess for receiving the leaf spring 36. The central groove 40 is provided with a rib which forms the bearing surface 38 and which may have an oblique form.

In any case, the bearing surface 38 provides a power source for the leaf spring 36 to return the slide element 20 from the release position back to its rest position.

In fact, the leaf spring 36, more specifically its free end 36A, is in contact with the bearing surface 38 in the rest position. When the slide element 20 is pushed forward to its release position, the leaf spring 36 begins to elastically deform and stores energy as the force exerted on the slide element 20 occurs from a user pushing the slide element 20. This stored energy will be released when the force exerted on the slide element 20 stops and the slide element 20 will naturally slide back to its rest position.

The connection of the slide element 20 to the handle body 14 and how it flexes the yoke 22 shall now be discussed in detail.

The handle body 14 may further be provided with at least two elongated tracks 42 located on both sides of the central groove 40 and extending along the longitudinal direction C-C (see FIG. 5).

The slide element 20 may further be provided with projections 44 (see FIG. 6) linearly movable along the tracks 42 to guide the slide element 20 in sliding movement relative to the handle body 14.

Figure 7:
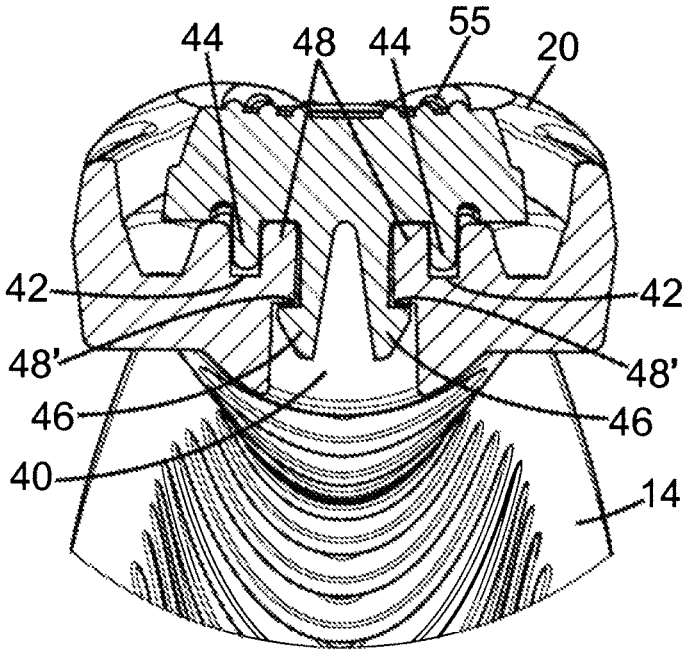
FIG. 7 is a cross-section of the razor handle shown in FIG. 3A along line VII-VII.

In order to permanently (lockingly) and slidably retain the slide element 20 on the handle body 14, the slide element 20 further includes latch elements 46. More precisely, the latch elements 46 include at least two hooks 46 extending inside the central groove 40 on both sides of the longitudinal direction C-C and snapping with corresponding elongated lips 48 provided on the handle body 14 as best seen in FIG. 7.

The slide element 20 may be snap-fitted on the handle body 14. When mounting the slide element 20 on the handle body 14, the hooks 46 are pressed together in order to be introduced inside the central groove 40 and slide along the lateral faces of the lips 48. Meanwhile the slide element 20 is pressed toward the upper face of the handle body until the hooks 46 arrive at the free end 48' of the lips, where the hooks 46 depart from one another and cover the free end 48' of the lips 48 forming a shoulder.

As best seen in FIGS. 4A, 4B, 5, 8A and 8B, each of the at least two arms 24 provided on the handle body 14 may be provided with a cam-follower 50, and the slide element may further include at least two cams 52, where the cam-followers 50 are driven by the cams 52 to flex the arms 24 when the slide element 20 is pushed forward in its release position.

Each of the cam-followers 50 includes a non-linear surface 50. More specifically, the cams 52 engage the cam-followers 50 to drive the arms 24. The cam-followers 50 are preferably leaning away from one another from back to front with regard to the longitudinal direction C-C such that when the slide element 20 moves forward in its release position, the yoke 22 flexes inwardly. When the slide element 20 returns rearward in its rest position, the yoke 22 deviates back in its open position.

Besides, to improve the resistance to outside forces exerted on the razor handle and to decrease the risk that the slide element 20 moves inadvertently forward, the surface forming each cam-follower 50 is further provided with a bulge 54 that provides a resistance to the movement of the cams 52. Thus, it is like each cam-follower 50 is separated in two parts by the bulge 54, a front part 50A corresponding to the forward-most part and a back part 50B corresponding to the rearward-most part.

In the rest position (see FIGS. 4A and 8A), the cams 52 are located in the back part 50B and are preferably in contact with, or at least near, the bulges 54. In the release position (see FIGS. 4B and 8B), the cams 52 are located in the front part 50A.

To release a shaving cartridge 16 connected to the handle 12 a user has to overcome the resistance of the slide element 20. Specifically, in an embodiment of the present invention, the resistance of the cams 52 abutting against the bulges 54 must be forced by the user. From the rest position (see FIGS.

4A and 8A), when a user overcomes this resistance and continues to push forward the slide element 20 while maintaining one of his/her fingers on the finger rest area 55 of the slide element 20, the cam-followers 50 glide along the cams 52. Because the cams 52 pass the bulges 54, they arrive in the front part 50A. Meanwhile, the arms 24 become closer to one another in flexing inwardly and the shell-bearings 26 separate from the rearwardly protruding connectors 28 on the shaving cartridge 16. The pusher 34 pushes the shaving cartridge 16 connected to the razor handle 12 away from the handle body 14 leading to the release of the shaving cartridge 16.

Because of the energy stored in the leaf spring 36, when the user releases the slide element 20, the slide element 20 returns back to its rest position and the cam-followers 50 glide along the cams 52. Because the cams 52 pass the bulges 54 they arrive in the back part 50B. The arms 24 depart from one another and the yoke 22 returns in its open position.

In order to avoid any inadvertent flexing of the arms 24, the razor handle 12 is further provided with a stop element. As best seen in FIGS. 4A, 4B, 8A and 8B, the stop element preferably includes at least two locators 56 provided on the slide element 20. An inner surface 58 is provided on each of the at least two arms 24 against which the corresponding locator 56 abuts in the rest position.

The at least two locators 56 extend toward the bottom part of the razor handle 12 and are located on both sides of the longitudinal direction C-C. More precisely, the two locators 56 are located on both sides of the elastic tongue 30. In a preferred embodiment of the present invention, the locators 56 are located symmetrically with regard to the longitudinal direction C-C and are separated from each other by a distance D56 taken between the two external (extreme) faces 56' of the locators 56.

Each inner surface 58 is similar to a longitudinal flange extending laterally on both sides of the longitudinal direction C-C. In a preferred embodiment of the present invention, the inner surfaces 58 are located symmetrically with regard to the longitudinal direction C-C and are separated from each other by a distance D58, which is equal to, or a little bit greater than, the distance D56 separating the locators 56. Preferably, in the rest position, the relationship between the values of D58 to D56 is comprised between 1 to 10%, more preferably about 5%. The distance D58 of the inner surfaces 58 is smaller in the release position, where the arms 24 are flexed, than in the rest position.

The lengths L58 and L56 may be chosen by a person skilled in the art such that the inner surfaces 58 abut against the locators 56 only when the arms 24 are pressed together while the slide element 20 is in its rest position.

Figure 4A:
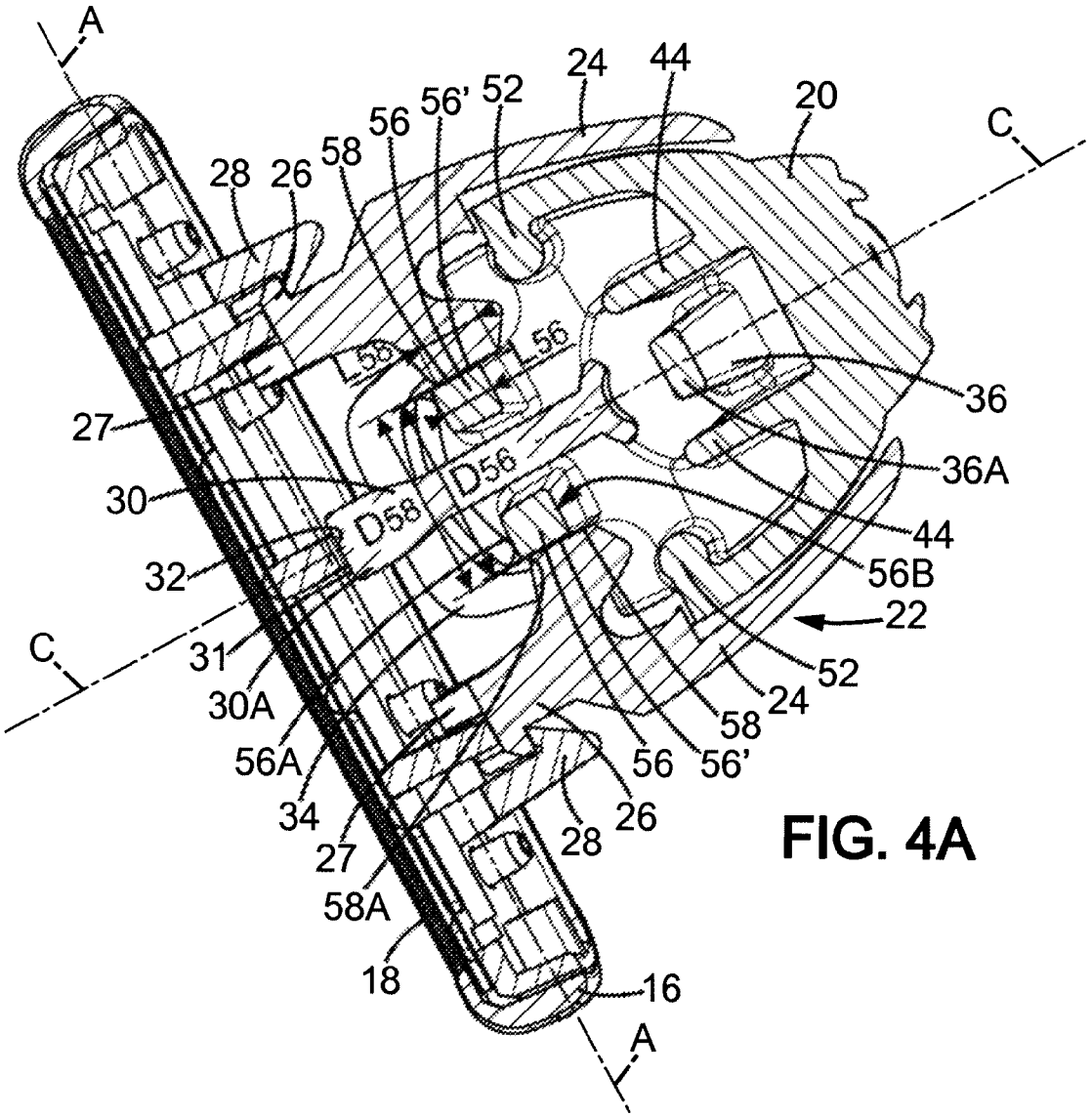
FIG. 4A is a longitudinal section of the razor handle shown in FIG. 2A along line IVA-IVA.
Figure 4B:
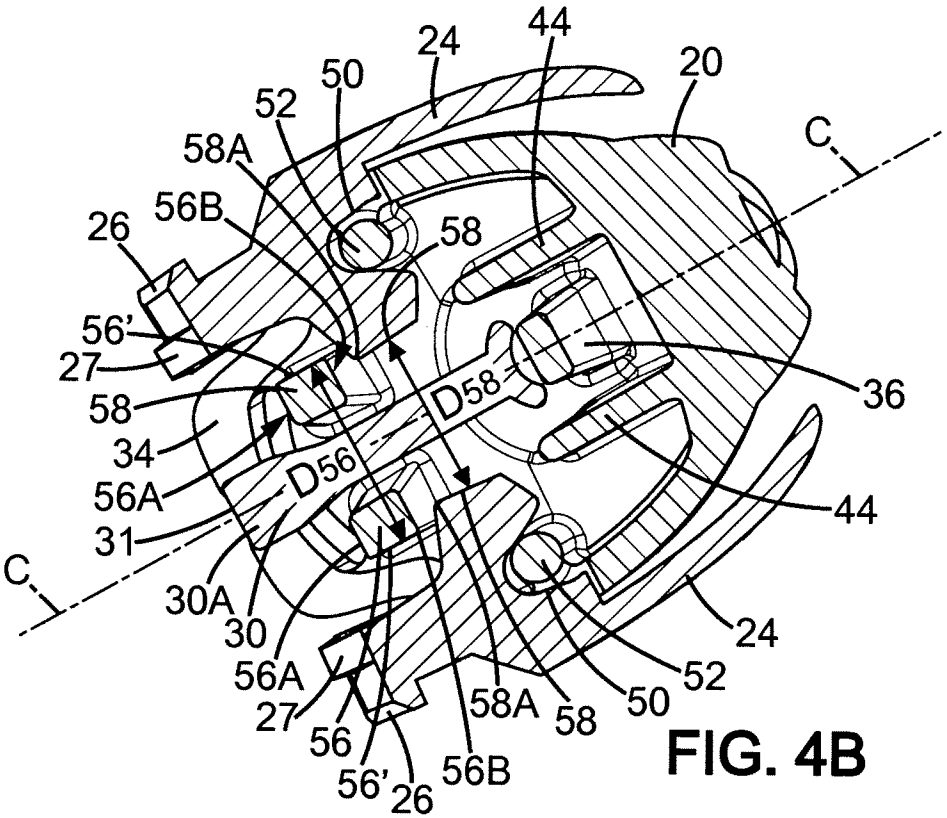
FIG. 4B is a longitudinal section of the razor handle shown in FIG. 2B along line IVB-IVB.
Figure 8A:
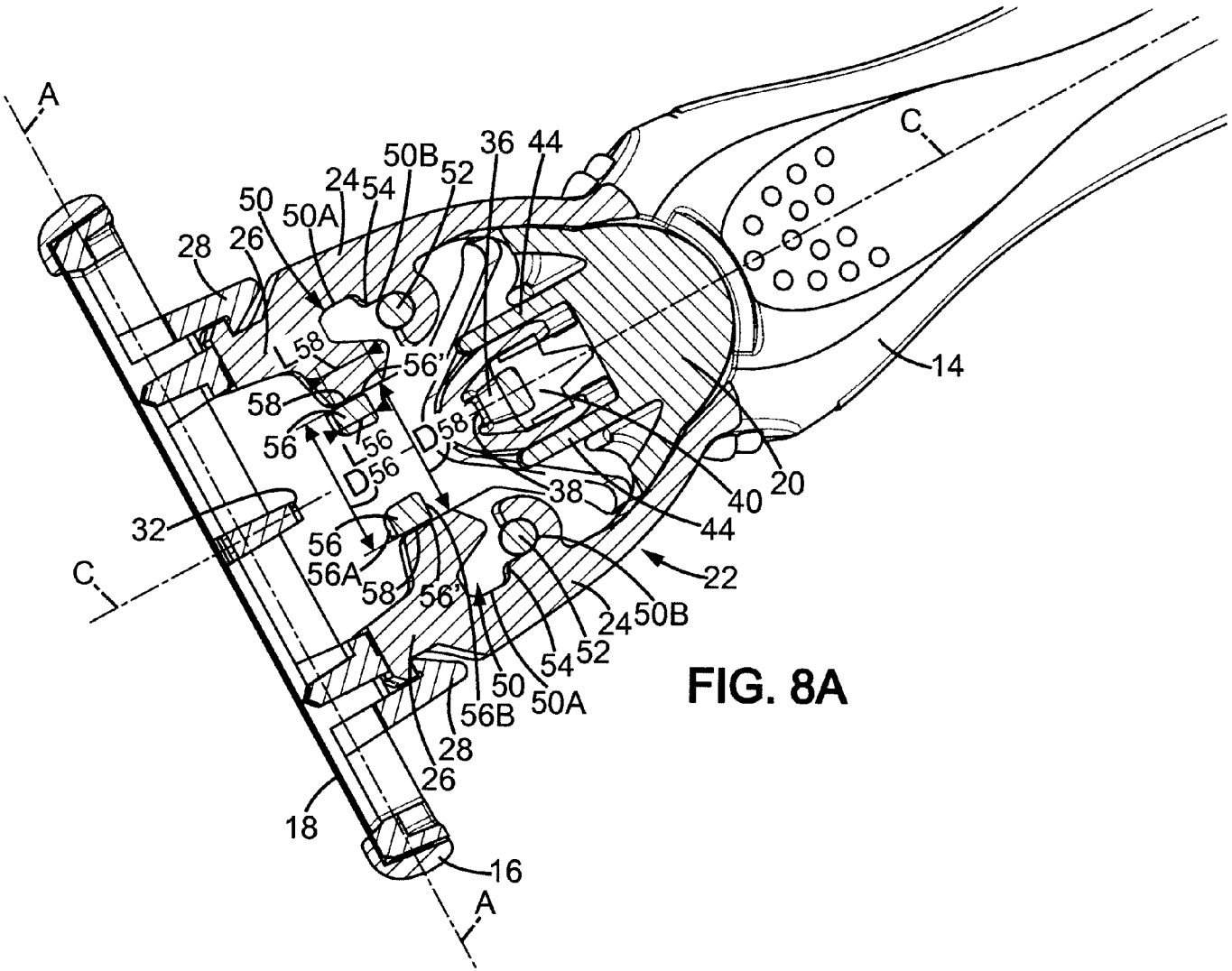
FIG. 8A is a longitudinal section of the razor handle shown in FIG. 2A along line VIIIA-VIIIA.
Figure 8B:
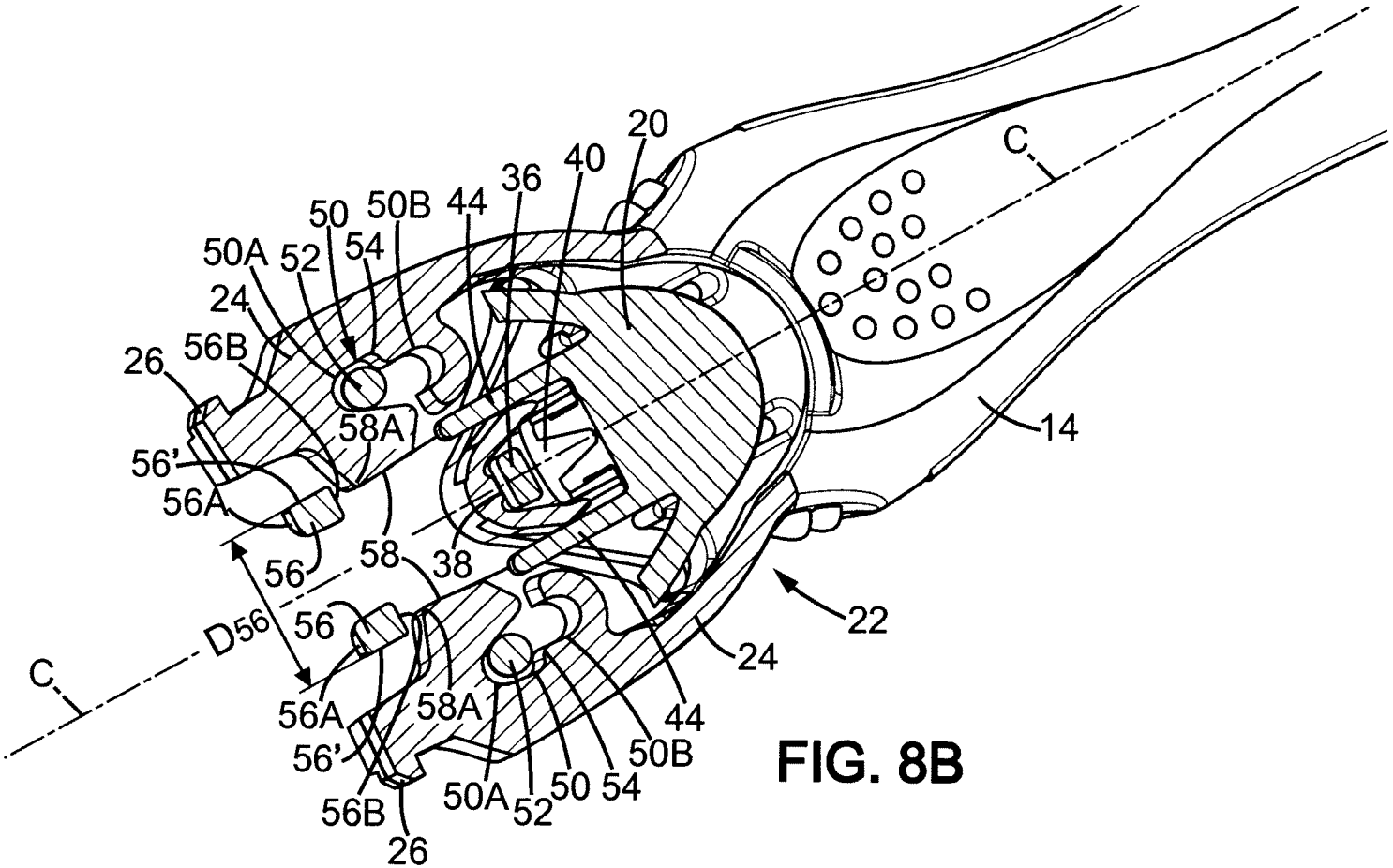
FIG. 8B is a longitudinal section of the razor handle shown in FIG. 2B along line VIIIB-VIIIB.

For example, when the slide element 20 is in its rest position, the locators 56, which preferably have a rectangular-shape, are completely retracted and are located substantially in front of the inner surfaces 58 which are preferably in a plane, meaning that the forward-most part 56A of the locators 56 is more or less in front of a part of the inner surfaces 58 as depicted in FIGS. 4A and 8A. When the slide element 20 is in its release position, the locators 56 are completely extending forward and no part of the locators 56 is located in front of any part of the inner surfaces 58, meaning that the rearward-most part 56B of the locators 56 is away from the forward-most part 58A of the inner surfaces 58 as depicted on FIGS. 4B and 8B.

In a preferred embodiment of the present invention, the relationship between the values of L58 to L56 is comprised between 5 to 20%, more preferably about 10%. When the slide element 20 moves from its rest position to its release position, the locators 56 also slide forward and move away from the inner surfaces 58. Therefore, because the locators 56 are no longer in front of the inner surfaces 58, the yoke 22, and more precisely the arms 24, can flex.

In the rest position (see 4A and 8A), the locators 56 are in abutment with, or at least in front of, the inner surfaces 58 and the yoke 22 is in its open position. When the anus 24 are pressed together (for example due to shock/forces during traveling or due to an inadvertent use by a child), the arms 24 cannot flex because their inner surfaces 58 abut against the locators 56. The locators 56 are sufficiently rigid so not to deform, such that they prevent any flexing of the arms 24. As a consequence, the shaving cartridge 16 cannot accidentally release.

In the release position (see 4B and 8B), the locators 56 are away from the inner surfaces 58. Therefore, when the arms 24 are pressed together, the arms 24 can flex because their inner surfaces 58 do not abut against the locators 56 and the shaving cartridge 16 can be released.

To release a shaving cartridge 16 connected to the razor handle 12, the slide element 20 has to be pushed forward and the resistance of the bulges 56 has to be overcome, and only after will the release of the shaving cartridge 16 occur.

Because of the embodiments described in the present invention, the risk of an accidental release of a shaving cartridge from a razor handle, which can especially occur when traveling, is lessened because the razor, and more specifically the actuator, can be exposed to several shocks/forces without such accidental release.

In an embodiment of the present invention, the handle body 14 and the slide element are made of a moldable rigid plastic material. Further, the elasticity of the leaf spring 36 integral with the slide element 20 is typically due to its specific shape (high ratios of length to width and of length to thickness).

One objective of the embodiments of the present invention is to avoid the drawbacks described in the Background of the Invention above. To this end, according to the embodiments of the present invention, the razor handle includes a stop element to prevent the yoke from inadvertently flexing when the slide element is in the rest position. Therefore, even in case of a shock or an inadvertent manipulation on the yoke, the shaving cartridge cannot be released.

In various embodiments of the invention, one or more of the following features may be incorporated:

- the stop element is provided on the slide element;
- the yoke flexes inwardly when the slide element is in the release position;
- the yoke includes at least two flexible arms, each arm being provided with a cam-follower and the slide element further includes at least two cams, the cam-followers being driven by the cams to flex the arms;
- each cam-follower includes a non-linear surface provided with a bulge providing a resistance to the movement of the cams;
- the stop element includes at least two locators and each of the at least two arms has an inner surface abutting against the corresponding locator while the slide element is in the rest position;
- the arms are provided with shell bearings such that the yoke can pivotably receive a shaving cartridge;
- the handle body is further provided with at least two elongated tracks and the slide element is further provided with projections linearly movable along the tracks to guide the slide element, and the slide element includes latch elements to permanently and slidably retain the slide element on the handle body;
- the spring member includes a leaf spring provided on the slide element and bearing against a bearing surface provided on the handle body;

the handle body is further provided with an elastic tongue for biasing a shaving cartridge toward a rest position; and the slide element is further provided with a pusher to push a shaving cartridge away from the handle body.

The embodiments of the present invention may also include a razor including such a razor handle connected to a shaving cartridge.

The invention claimed is:

1. A razor handle comprising:

an elongated handle body integral with a flexible yoke for receiving and releasably retaining a shaving cartridge, the yoke comprising at least two flexible arms;

a slide element cooperating with the yoke and connected to the handle body, the slide element being movable relative to the handle body between a rest position, in which the yoke is open and can releasably retain a shaving cartridge received in the yoke, and a release position, in which the yoke is flexed and can receive a shaving cartridge or release a shaving cartridge received in the yoke; and a spring member to return the slide element from the release position to the rest position;

wherein the razor handle further comprises a stop element to prevent the yoke from inadvertently flexing when the slide element is in the rest position, wherein the stop element comprises at least two locators, and wherein each of the at least two arms has an inner surface abutting against a corresponding locator when the slide element is in the rest position.

2. The razor handle according to claim 1, wherein the stop element is provided on the slide element.

3. The razor handle according to claim 1, wherein the yoke flexes inwardly when the slide element is in the release position.

4. The razor handle according to claim 1, wherein each arm comprises a cam-follower, and wherein the slide element further comprises at least two cams, the cam-followers being driven by the cams to flex the arms.

5. The razor handle according to claim 4, wherein each cam-follower comprises a non-linear surface with a bulge providing a resistance to a movement of the cams.

6. The razor handle according to claim 4, wherein the arms are provided with shell bearings such that the yoke can pivotably receive a shaving cartridge.

7. The razor handle according to claim 1, wherein the handle body further comprises at least two elongated tracks, wherein the slide element further comprises projections linearly movable along the tracks to guide the slide element, and wherein the slide element further comprises a latch element to permanently and slidably retain the slide element on the handle body.

8. The razor handle according to claim 1, wherein the spring member comprises a leaf spring provided on the slide element, the leaf spring bearing against a bearing surface provided on the handle body.

9. The razor handle according to claim 1, wherein the handle body further comprises an elastic tongue for biasing a shaving cartridge toward the rest position.

10. The razor handle according to claim 1, wherein the slide element further comprises a pusher to push a shaving cartridge away from the handle body.

11. The razor handle according to claim 10, further comprising a razor cartridge connected to the razor handle.

* * * * *